US010807217B2

(12) United States Patent
Ross et al.

(10) Patent No.: US 10,807,217 B2
(45) Date of Patent: Oct. 20, 2020

(54) RATCHET GEAR REINFORCING RING

(71) Applicant: Snap-on Incorporated, Kenosha, WI (US)

(72) Inventors: David T. Ross, Beach Park, IL (US); Richard L. Hopper, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 207 days.

(21) Appl. No.: 15/622,319

(22) Filed: Jun. 14, 2017

(65) Prior Publication Data

US 2018/0361545 A1 Dec. 20, 2018

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01)

(58) Field of Classification Search
CPC ..... B25B 13/46; B25B 13/461; B25B 13/462; B25B 13/463; B25B 13/465; B25B 23/0007; B25B 15/04; B25B 21/004; B25B 13/467
USPC ..... 81/60, 62
See application file for complete search history.

(56) References Cited

U.S. PATENT DOCUMENTS 2,138,331 A 11/1938 Ward
5,140,875 A 8/1992 Kim
5,178,047 A 1/1993 Arnold, II et al.
5,199,330 A 4/1993 Arnold et al.
6,263,768 B1 7/2001 Huang et al.
6,435,062 B1 * 8/2002 McCann ..... B25B 13/463 81/60
6,966,241 B2 * 11/2005 Huang ..... B25B 13/463 192/43.2
7,210,380 B1 5/2007 Wu
7,213,492 B2 5/2007 Tsai
7,299,720 B1 11/2007 Schultz et al.
(Continued)

FOREIGN PATENT DOCUMENTS

CN 205572270 9/2016
TW M246105 10/2004
(Continued)

OTHER PUBLICATIONS

UK Combined Search and Examination Report for Application No. GB1806646.4, dated Oct. 16, 2018, 6 pages.
(Continued)

*Primary Examiner* — David B. Thomas
*Assistant Examiner* — Robert F Neibaur
(74) *Attorney, Agent, or Firm* — Seyfarth Shaw LLP

(57) ABSTRACT

A ratchet head uses a radially-locking retaining ring to secure a ratchet gear within the head, reducing the load on a cover plate. The retaining ring opposes off-axis force when the ratchet head is experiencing cantilever-type loads, such that the body of the ratchet head absorbs the force rather than the cover plate enclosing the head. With the ratchet head assembled with the retaining ring opposing off-axis force, rather than the cover plate, the weight and position of the screws securing the cover plate to the body are independent of the maximum torque rating of the head. This also improves the integrity of the seal provided by the cover plate.

31 Claims, 3 Drawing Sheets

(56) References Cited

U.S. PATENT DOCUMENTS

| | | | | |
|---|---|---|---|---|
| 7,353,735 | B2 * | 4/2008 | Patel | B25B 13/463 81/60 |
| 8,387,489 | B2 | 3/2013 | Hsu | |
| 8,413,550 | B2 | 4/2013 | Hu | |
| 8,499,666 | B2 * | 8/2013 | Hopper | B25B 13/463 81/63.1 |
| 8,806,986 | B2 * | 8/2014 | Chen | B25B 1/02 81/62 |
| 9,038,505 | B2 * | 5/2015 | He | B25B 17/00 81/57.29 |
| 2002/0005093 | A1 | 1/2002 | Daigle et al. | |
| 2003/0150299 | A1 | 8/2003 | Chen | |
| 2003/0177872 | A1 * | 9/2003 | Shu-Ying | B25B 13/463 81/63.2 |
| 2003/0221521 | A1 | 12/2003 | Shu-Ying et al. | |
| 2005/0044997 | A1 | 3/2005 | Liu | |
| 2005/0145074 | A1 | 7/2005 | Mau | |
| 2005/0257649 | A1 | 11/2005 | Chen | |
| 2008/0210061 | A1 | 9/2008 | Yu | |
| 2008/0229889 | A1 | 9/2008 | Hopper et al. | |
| 2012/0186400 | A1 | 7/2012 | Elger | |
| 2013/0047791 | A1 | 2/2013 | Hsu | |
| 2013/0139656 | A1 | 6/2013 | Chang | |
| 2013/0213190 | A1 | 8/2013 | Chen | |
| 2013/0228049 | A1 * | 9/2013 | Shen | B25B 13/463 81/63.1 |
| 2013/0283982 | A1 | 10/2013 | Hopper et al. | |
| 2014/0083259 | A1 * | 3/2014 | Anderson | B25B 13/463 81/63.1 |
| 2014/0311301 | A1 | 10/2014 | Tucker | |
| 2015/0075333 | A1 | 3/2015 | Chen | |
| 2016/0199966 | A1 | 7/2016 | Wang | |
| 2017/0197298 | A1 * | 7/2017 | Yu | B25B 13/462 |

FOREIGN PATENT DOCUMENTS

| | | |
|---|---|---|
| TW | M374387 | 2/2010 |
| TW | M429560 | 5/2012 |
| TW | 201226117 | 7/2012 |
| TW | 201330985 | 8/2013 |
| TW | 201603959 | 2/2016 |
| TW | M1517067 | 2/2016 |

OTHER PUBLICATIONS

Australian Examination Report No. 1 for Application No. 2018202738 dated Feb. 20, 2019, 3 pages.

Taiwan Office Action for Application No. 107120313 dated Feb. 22, 2019, 13 pages.

Examiner's Report for Canadian Patent Application No. 3,005,114 dated Apr. 10, 2019, 3 pages.

UK Examination Report for Application No. GB1806646.4, dated Aug. 7, 2019, 3 pages.

Chinese Office Action for Application No. 201810609377.5 dated Dec. 10, 2019, 9 pages.

Combined Search and Examination Report for United Kingdom Application No. GB2000099.8 dated Feb. 18, 2020, 7 pages.

* cited by examiner

RATCHET GEAR REINFORCING RING

TECHNICAL FIELD OF THE INVENTION

The invention relates to a ratcheting mechanism and, in particular, to an improved structure and method for retaining a ratchet gear within a housing to avoid loading a housing cover plate.

BACKGROUND OF THE INVENTION

In the design of ratcheting socket wrenches, it is common to enclose the internal mechanism of the tool with a cover plate which both maintains the internal components in place as well as keeps dirt and debris out of the internal mechanism. The cover plate is commonly retained in the assembly by screws. Screws provide a positive load on the cover plate, keeping the cover plate tight against the housing and maintaining a seal which keeps contaminants out of the ratchet mechanism internals.

For example, in existing screw-retained designs, in order to provide a compact ratchet head, the screws may be located low on the ratchet head, closer to the end connected to the yoke/shaft of the tool than to the ratchet's drive post. Because of this positioning, even a thickly-constructed cover plate will have difficulty keeping the ratchet gear in place when experiencing cantilever-type loads. Deflection of the cover plate under these types of loads will also compromise the cover plate's ability to keep debris and dirt out of the interior of the ratchet mechanism.

SUMMARY OF THE INVENTION

An improved ratcheting head includes screws to maintain a positive clamping load on the cover plate, and a radially-locking retaining ring under the cover plate whose primary purpose is to keep the keep the ratcheting gear in place. With the retaining ring retaining the ratchet gear rather than the cover plate and the screws, the screws are able to maintain the cover seal even when the ratcheting gear is experiencing cantilever-type loads. Since loading forces are removed from the cover plate, the thickness of the cover plate and position of the screws are independent of the load rating of the ratcheting head. The invention further includes a method of assembling the improved ratcheting head.

BRIEF DESCRIPTION OF DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
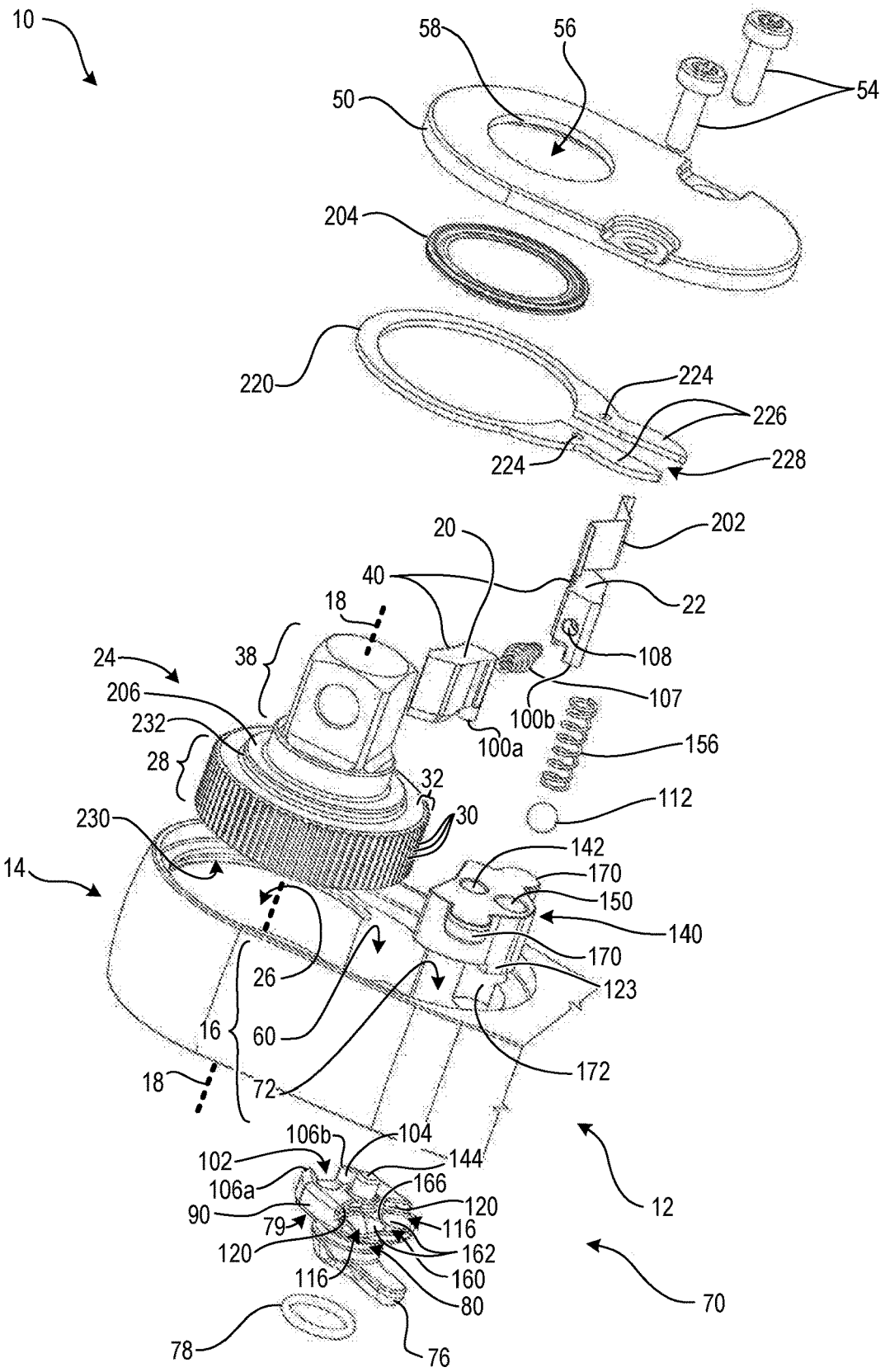
FIG. 1 is a perspective view of a head of a ratchet tool in accordance with a first embodiment of the present invention.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention and is not intended to limit the broad aspect of the invention to any one or more of the embodiments illustrated or disclosed. As used herein, the term "present invention" is not intended to limit the scope of the claimed invention, and is instead a term used to discuss exemplary embodiments of the invention for explanatory purposes only.

FIG. 1 illustrates an example of an improved ratchet head design that utilizes screws 54 to positively clamp a cover plate 50, while utilizing a radially-locking retaining ring 200 to secure the ratchet gear 24 under the cover plate. The screws 54 provide a clamping load to keep the cover plate's sealed against the housing. The retaining ring 220 locks into a groove 230 in the drive cavity 26 of the ratchet-head body 14, maintaining the position of the gear 24 under different loads. A low screw location on the housing no longer affects the retention of the gear 24 under load. As an additional benefit, the cover plate 50 can be made thinner, thereby offsetting any additional thickness that might be required in the ratchet-head assembly to accommodate the retaining ring 220.

The ratchet head 10 is shown as having an end 12 that may be coupled to a shaft (not shown) on an elongated handle (not shown) by a pivoting yoke, or the end 12 may be integral with the shaft. The ratchet head 10 includes a body 14 having the end 12 and having a cavity 16 for receiving internal and external components of the ratchet head 10. The ratchet head 10 is used to provide torque to a working piece (not shown), such as a socket, other tool, and/or a fastener.

The ratchet head 10 is of a type of ratchet known as a "dual-pawl" ratchet, allowing a user to selectively determine a torque direction. The ratchet head 10 includes first and second pawls 20, 22 that are selectively engaged with a ratchet gear 24. The ratchet gear 24 is operatively engageable with the working piece. When the first pawl 20 is engaged with the ratchet gear 24, torque drive is permitted with rotation of the ratchet head 10 in a first rotational drive direction, while slippage occurs with rotation of the ratchet head 10 in a second rotational drive direction opposite the first. Conversely, when the second pawl 22 is engaged with the ratchet gear 24, the first pawl 20 moves out of engagement with the ratchet gear 24, and torque drive is permitted with rotation of the ratchet head 10 in the second drive direction while slippage occurs in the first drive direction.

A bias member such as leaf spring 202 may be used to limit pawl travel during ratcheting. One surface of the leaf spring 202 engages the back of the pawls 20, 22, opposite a front-side of the pawls having the teeth 40. An opposite surface of the leaf spring 202 engages a spacer 140 that pivots in accordance with the direction set for ratcheting. The direction of ratcheting is set by a reversing lever portion 76 attached to a reversing disk portion 90 that causes the spacer 140 to pivot, thereby changing the bias provided by the leaf spring 202. The leaf spring 202 selectively biases the pawls 20, 22 in a direction toward the ratchet gear 24 and restricts travel of the pawls 20, 22 during a ratcheting operation. This also increases the minimum ratchet travel between loading.

The cavity 16 includes several portions for receiving and retaining the components therein. The ratchet gear 24 is received in a first generally circular portion of the cavity 16, referred to herein as the drive cavity 26. The ratchet gear 24 has a generally circular body portion 28 with ratchet gearing or teeth 30 on a circumferential surface 32 and has an upstanding drive post 38, which may have a square cross-section. The ratchet teeth 30 engage with pawl teeth 40 formed on the pawls 20, 22 for selective engagement with the pawls 20, 22 to provide torque via the drive post 38.

The pawls 20, 22 are located in a further portion of the cavity 16, referred to herein as the pawl cavity 60, and the drive cavity 26 and pawl cavity 60 are overlapping or communicating to permit the pawls 20, 22 to move into and out of engagement with the ratchet teeth 30 of the ratchet gear 24.

An actuator that selectively engages and disengages the pawls 20, 22 with the ratchet gear 24 is provided, referred to herein as a reversing lever mechanism 70. The reversing lever mechanism 70 is received in a further cavity portion of the cavity 16, referred to herein as the actuator cavity 72. A throughbore 74 (illustrated in FIG. 2) is provided on the bottom of the body 14 so that a lever portion 76 of the reversing lever mechanism 70 may extend from the actuator cavity 72 via the throughbore 74. The lever portion 76 serves as an actuator of the reversing lever mechanism 70, is positioned on the outside of the ratchet head 10, and is manually operated to select a drive direction by a user.

A gasket seal 78 is positioned in a seat portion 80 between a portion 79 of the reversing lever mechanism 70 formed by or abutting the disc portion 90. The gasket seal 78 circumscribes a neck portion connecting the reversing disc portion 90 to the lever portion 76. The neck portion extends into and through the throughbore 74, while the gasket 78 impedes or prevent contaminants from entering the working portions of the ratchet head 10.

Figure 2:
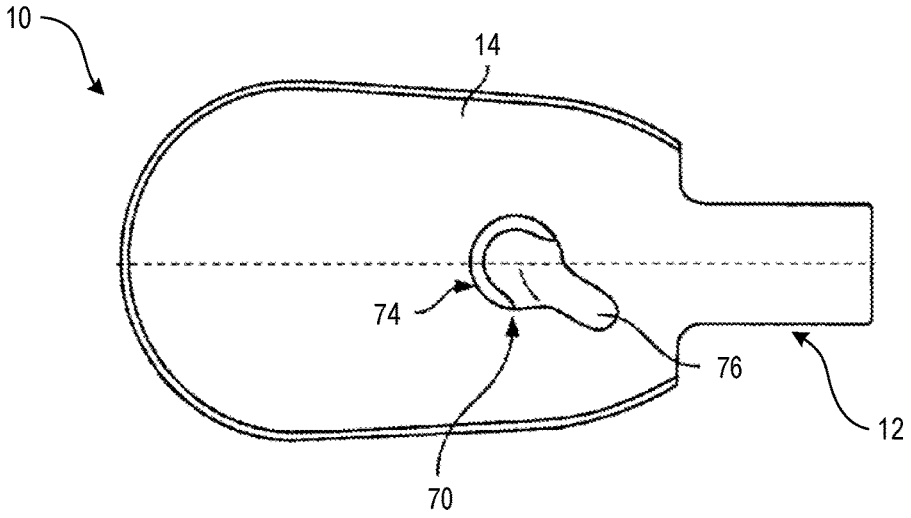
FIG. 2 is a bottom plan view of an assembled ratchet tool head of FIG. 1.
Figure 5:
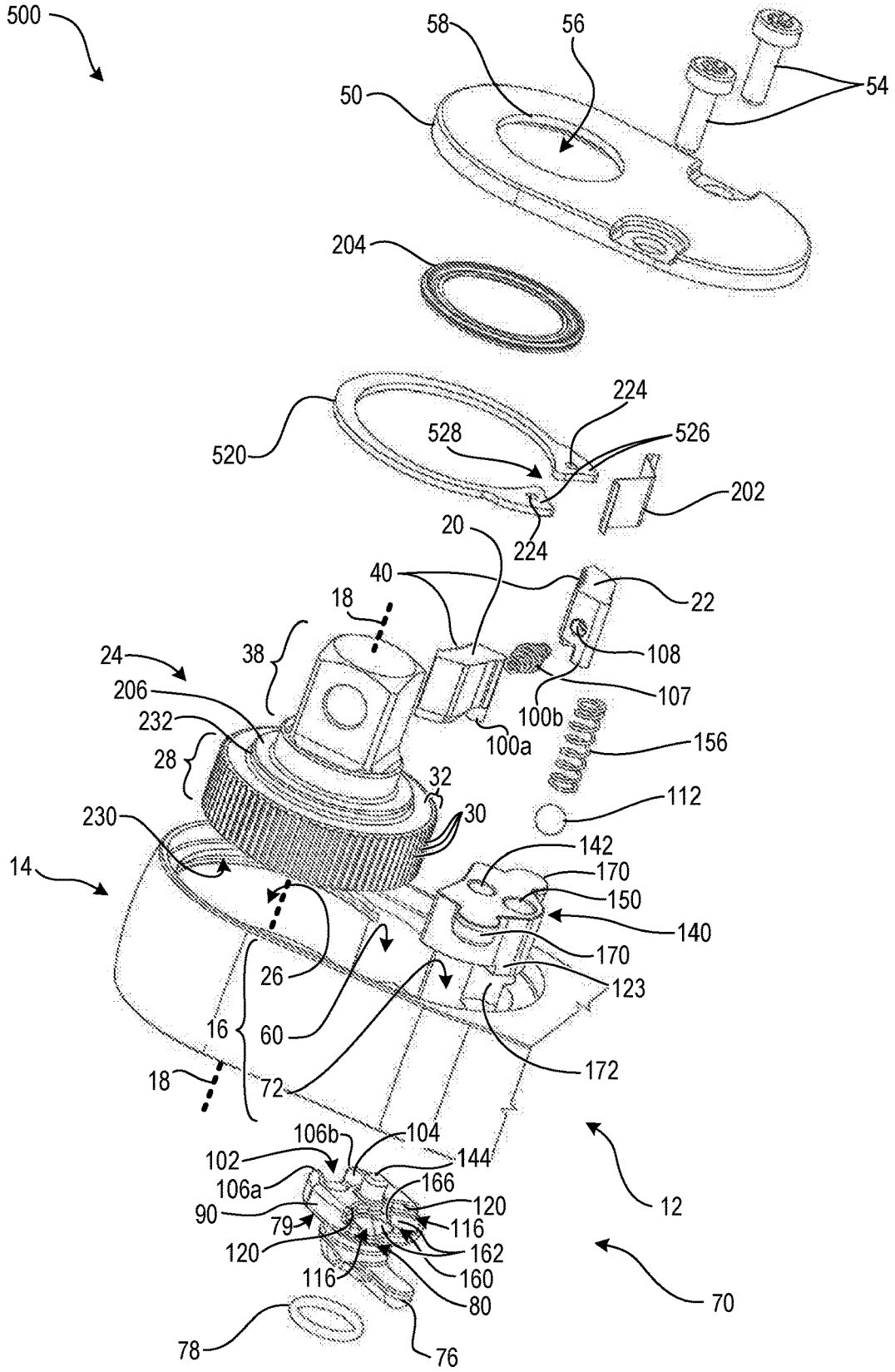
FIG. 5 is a perspective view of a head of a ratchet tool in accordance with a second embodiment of the present invention.

The reversing lever mechanism 70 is assembled with the body 14 by inserting the lever portion 76 of the reversing lever mechanism 70 into the actuator cavity 72 from a first side of the ratchet body 14 (the upper side as viewed in FIG. 1), and by extending the lever portion 76 through the throughbore 74 to a second side of the ratchet body 14 (the lower side relative to the head in FIGS. 1 and 5, and as illustrated in FIG. 2). This promotes the ability to utilize the gasket seal 78 for preventing ingress of contaminants. On the cavity-side of the throughbore 74, the neck ends at a portion 79 which is sized to prevent passage of the reversing lever mechanism 70 through the throughbore 74. The gasket seal 78 may be compressed and/or held in position between the body 14 and the portion 79 of the reversing lever mechanism 70. From within the cavity 16, the reversing lever mechanism 70 itself may be held in position by a spacer 140, discussed below.

A reversing disc portion 90 of the reversing lever mechanism 70 is selectively rotated using the lever portion 76 to select one of the pawls 20, 22, thereby setting a drive direction. Each of the pawls 20, 22 has a selector post 100 that is manipulated by the reversing disc portion 90. More specifically, the reversing disc portion 90 has a recess 102 defined by a surface 104 and by hooks 106 which interact with the selector posts 100.

As the disc portion 90 is shifted to one position for a selected drive direction, a first hook **106*a* catches a selector post 100*a* of, for example, the first pawl 20, and continued rotation of the reversing disc 90 draws the first pawl 20 away from and out of engagement with the drive portion ratchet teeth 30, the selector post 100*a* being pulled into the recess 102. Simultaneously, a second hook 106*b* that was engaged with a selector post 100*b* of the second pawl 22 allows the selector post 100*b* to move from the recess 102 so that the second pawl 22 shifts to becomes engaged with the drive portion ratchet teeth 30. A bias member such as a coil spring 107 is positioned between the pawls 20, 22. The ends of the spring 107 are received and retained by a bore 108 formed in a side of each pawl 20, 22. The respective bores 108 of the two pawls 20, 22 are in an opposed orientation so that the spring 107 biases the pawls 20, 22** away from each other.

In this manner, when the disc portion 90 catches a selector post 100 of one of the pawls 20, 22, causing the pawl to move, the spring 107 causes the other pawl to shift position. Additionally, the spring 107 allows the pawl to cam or deflect away from the ratchet gear teeth 30 when a first drive direction is selected but the ratchet head 10 is rotated in reverse, in an opposite direction, to allow slippage in that direction. The spring 107 then forces the pawl to return to engagement with the teeth 30 when such reverse movement ceases.

As noted above, a spacer 140 is provided to position the reversing lever mechanism 70. The reversing lever mechanism 70 is positioned between a bottom of the basin formed by the cavity 16 in the ratchet body 14 and the spacer 140. As illustrated in the embodiment in FIG. 1, the spacer 140 abuts a bottom side of the lug arms 226 of the retaining ring 220 beneath the cover plate 50, such that the arms 226 may be used to secure the pawls 20, 22 and spacer 140 in place.

The spacer 140 includes a recess 142 into which a lever post 144 of the reversing lever mechanism 70 is received. This upstanding post 144 serves as a pivot, with a generally circular geometry, and the recess 142 is generally circular so as to form a pivot or bearing surface with the reversing lever post 144. The axis of rotation of the reversing lever mechanism 70 around the pivot is parallel to the axis of rotation 18 of the ratchet gear 24 and the drive post 38, as positioned through the circular bore 56 in the cover plate 50.

The ratchet head 10 is preferably designed to promote a tactile feel for a user to identify when the reversing lever portion 76 is in a proper position for the two drive directions. Towards this end, a ball and detent structure are provided, as is common in devices of this type. More specifically, the spacer 140 has a throughbore 150 into which a ball 112 in inserted from an upper opening of the throughbore 150 so that the ball 112 is positioned proximate a lower opening in the throughbore 150 ("upper" and "lower" as used herein are relative to the orientation of the ratchet head on the page as illustrated in FIGS. 1 and 5). A spring 156 is inserted into the throughbore 150 via the upper opening. As illustrated in the embodiment in FIG. 1, one end of the spring 156 is held in position in the throughbore 150 by the cover plate 50, and the other end of the spring 156 contacts the ball 112, with the spring 156 transecting the plane of the retaining ring 220 by passing through the gap 228 between the lug arms 226. In this manner, assembling the ball 112 and spring 156 is simplified, and manufacturing of the ratchet head 10 is simplified by not having to balance or otherwise hold the ball 112 on the spring 156 during assembly, as is the case with conventional designs.

The spacer throughbore 150 is positioned outboard from the axis of rotation of the reversing lever mechanism 70 (the axis of rotation being defined by the pivoting of the lever post 144 in the recess 142). Therefore, as the reversing lever mechanism 70 is rotated, the ball 112 contacts and moves along a surface 160 formed on the disc portion 90. The surface 160 includes a pair of detents or troughs 116 positioned thereon to correspond to proper positions for the ball 112 when the reversing lever mechanism 70 is in the proper position for the first and second drive directions. The surface 160 includes first and second ramps 162 that meet generally between the troughs 116 at a peak 166. The peak 166 is positioned along an arc in consideration of the rotation of the reversing lever 70 relative to the ball 112 positioned in the spacer throughbore 150. Preferably, the ramps 162 are linear or flat (rise and run are in direct relation).

With the reversing lever mechanism 70 in an initial position with the ball 112 positioned in a first of the troughs 116, the reversing lever portion 76 may be rotated thereby forcing the ball 112 to ride up one of the ramps 162 and forcing the spring 156 to compress. Once the ball 112 passes over the meeting point or peak 166 where the ramps 162 meet, the spring 156 provides a bias to advance the reversing lever mechanism 70 towards a second of the troughs 116. When the ball 112 is aligned with one of the troughs 116, the ball 112 at least partially extends from the spacer throughbore 150.

The spacer 140 is mounted in the ratchet body 14. The spacer 140 includes at least one and preferably two portions 170 having complementary shapes to portions 172 of the ratchet body 14 so that the spacer 140 may be assembled easily, such as in a linear fashion, into a defined position. In the illustrated form, the spacer portions 170 are in the form of partially circular wings or ears that are received in ear recesses 172 formed to the sides of the actuator cavity 72. In this manner, the spacer 140 may be properly positioned easily. In the embodiment in FIG. 1, the lug arms 226 of the retaining ring 220 abut an upper surface of the spacer 140, and prevent the spacer 140 from moving from the assembled positioned, without the need for screws or other securements.

In order to promote the tactile feel for the user, as well as to promote rotation of a proper amount, a stop mechanism is provided. As illustrated, this stop mechanism is provided by structure formed on the reversing disc portion 90 and the spacer 140. However, it should be noted that the structure may be provided on any portion of the components used for reversing the direction and on any portion of the components that remain relatively stationary when the reversing lever mechanism 70 is pivoting/rotating. Here, the reversing disc portion 90 includes a first and second stops surfaces 120 formed proximate the troughs 116. Rotation of the reversing lever mechanism 70 causes the stop surfaces 120 to move into contact with stops formed on a portion 123 of the spacer 140. In this manner, over-rotation of the reversing lever mechanism 70 is prevented, and the user is provided with a positive tactile feel of full rotation.

After the ratchet gear 24, reversing lever mechanism 70, pawls 20, 22, spacer 140, and associated components are assembled in the ratchet head 10, a retaining ring 220 is radially locked into a groove 230 in the sidewall of the drive cavity 26. The groove 230 is oriented in parallel, or substantially parallel, to a surface of the body 14 at the upper opening of the drive cavity 26, and is proximate to that surface. The retaining ring 220 has a circular or oval inner ring opening, with external lug arms 224 (that is, lug arms directed away from the inner ring opening). The ring body may optionally be tapered, having a greater width opposite the gap 228 than along the sides joining the lug arms 226. Each lug arm 226 includes a lug hole 224, which are provided for compressing the gap 228 to facilitate insertion of the retaining ring 220 into the groove 230, as well as allowing removal of the retaining ring 220 by compressing the arms 226 toward each other to facilitate disassembly of the head 10. In the embodiment illustrated in FIG. 1, the lug arms 226 extend into the pawl cavity 60 and actuator cavity 72, holding the pawls 20, 22 and spacer 140 in place, in addition to securing the ratchet gear 24.

Figure 3:
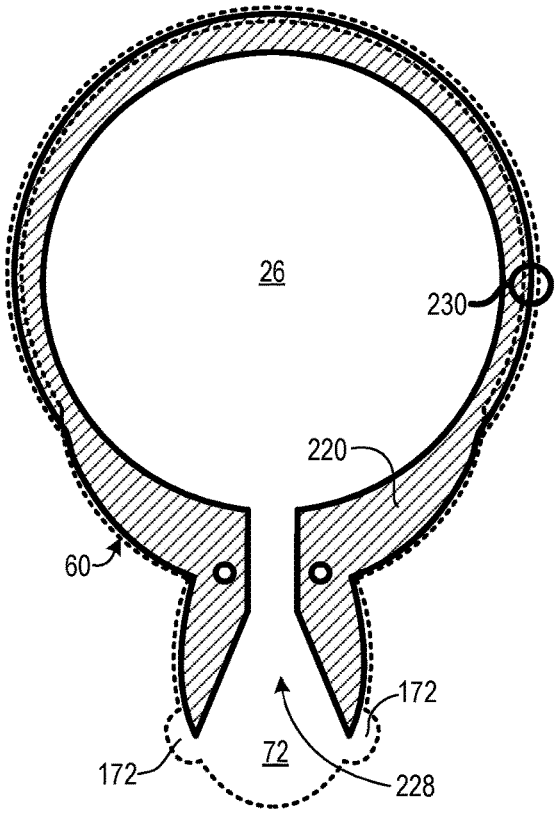
FIG. 3 is a cross-sectional view illustrating a cross section of the housing relative to a retaining ring in the head of FIG. 1.

FIG. 3 illustrates a cross-section of the sidewalls of the cavity 16 relative to the retaining ring 220. The ring body of the retaining ring 220 is locked radially into the groove 230 in the wall of the drive cavity 26. The lug arms 226 extend outward from the ring body, away from the ring opening, into the pawl cavity 60 and actuator cavity 72. The walls of the pawl cavity 60 and actuator cavity 72 may act as stops against the outer edges of the lug arms 226 to prevent the free rotation of the retaining ring 220 in the cavity 16. The retaining ring 220 secures the ratchet gear 24 in place, while the lug arms 226 secure the pawls 20, 22 and the spacer 140. The spring 156 transects a plane of the retaining ring through the gap 228 between the lug arms 226, with the cover plate 50 securing the spring 156 within the head 10. Optionally, the groove 230 may extend along the sidewall of the body 14 into the pawl cavity 60 and/or the actuator cavity 72, securing a periphery of the lug arms to the body 14 in the same manner that the groove 230 secures the periphery of the ring body.

Figure 4:
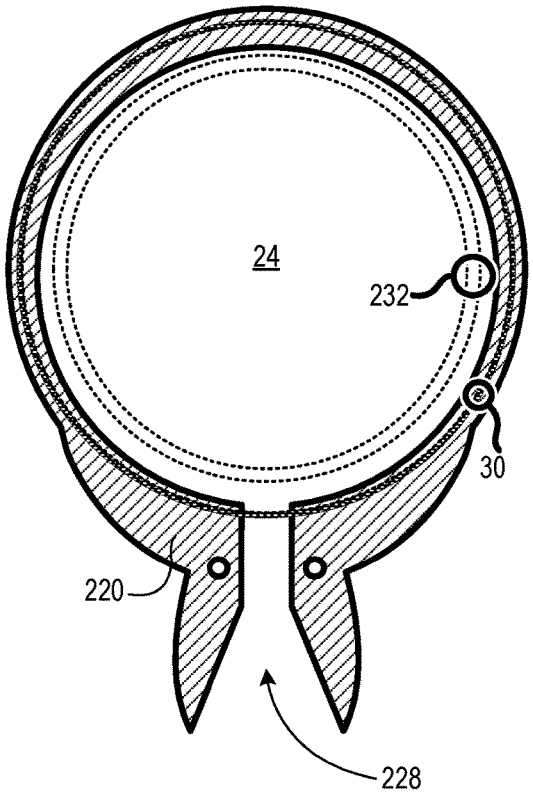
FIG. 4 is a cross-sectional view illustrating a cross section of the ratchet gear relative to the retaining ring in the head of FIG. 1.

FIG. 4 illustrates a cross-section of the ratchet gear 24 relative to the retaining ring 220. The ratchet gear 24 includes a groove 232 between the circular body portion 28 and the drive post 38. A lower surface of the groove 232 is provided along the circular body portion 28 and an upper surface of the groove 232 is provided below a gasket seat 206 that is used to seat a gasket seal 204 between the ratchet gear 24 and the cover plate 50. When the ratchet gear is in place in the body 14, the groove 232 of the ratchet gear 24 is aligned in a same cross-sectional plane as the groove 230, the plane being orthogonal to the axis of rotation 18 of the ratcheting gear 24. The groove 232 receives/engages an inner portion of the retaining ring 220 and the groove 230 receives/engages an outer portion of the retaining ring 220 to retain the ratchet gear 24 in the body 14.

The inner diameter of the groove 232 accommodates compression of the retaining ring, providing space to axially compress the retaining ring 220 during assembly and disassembly of the head 10. The inner diameter of the groove 232 in the ratchet gear 24 is at least small enough to receive the ring 220 when the lug holes 224 are compressed toward each other to reduce the gap 228 so as to compress the ring 220 for insertion or removal from the groove 230, engaging and disengaging the ring 220 from the groove 230 in the body 14.

A surface of the retaining ring faces and abuts the surface 32 of the circular body portion 28, locking the ratchet gear 24 in place within the body 14. With the ratchet gear 24 locked in place, a gasket seal 204 is positioned on the gasket seat 206 of the ratchet gear 24. The outer diameter of the gasket seal 204 is independent of the inner diameter of the ring body of the retaining ring 220, but ordinarily will not overlap the retaining ring 220 so as to avoid excess resistance to rotation of the drive post 38. The cover plate 50 is then secured to an upper surface of the body 14, such as by screws 54. The cover plate 50 includes a circular bore 56 through which the drive post 38 projects for operative engagement with a working piece. The circular bore 56 also defines a bearing surface 58 to align the drive post 38. A lower surface of the cover plate 50 abuts an upper surface of the gasket seal 204 opposite the seat 206, preventing ingress of contaminants.

The retaining ring in FIGS. 1, 3, and 4 maintains the position of the ratchet gear 24 under load, while the screws 54 securing the cover plate 50 provide a clamping load to keep the cover plate's seal to the body 14. A low screw location on the housing, close to the handle end 12, will no longer affect retention of the gear 24. The thickness of the cover plate 50 is also made independent of the torque limits of the head 10, such that the cover plate 50 may be made thinner than would otherwise be possible for any given maximum torque rating. The ability to use a thin cover plate 50 can be used to at least partially offset the added thickness of the head 10 that is required in order to accommodate the retaining ring 220 and the grove 230.

FIG. 5 illustrates a ratchet head 500 that is structurally identical to ratchet head 10 in FIG. 1, but which uses a retaining ring 520 that has stub-style lug external lug arms 526 with a gap 528 therebetween. The ring body of the retaining ring 520 is unchanged, but the lug arms 526 do not extent into the actuator cavity 72, and overlap with a smaller portion of the pawl cavity than the lug arms 226 of the retaining ring 220 in FIG. 1. With less overlap of the components in the pawl cavity 60 and actuator cavity 72, there is more space to accommodate the height of those components. For example, the dimensions of the spacer 140 and reversing level 70 may be of conventional dimensions, reducing the cost manufacturing the ratchet head 50 and/or facilitating a reduction in head thickness. While the lug arms 526 may facilitate holding the pawls 20, 22 in place, the screws 54 and the cover plate 50 may be used to hold the spacer 140 in place.

The construction of the ratchet heads 10 and 500, as described, simplify manufacturing and assembly costs. The gasket slides The reversing lever mechanism 70 is inserted into the cavity 16 so that the lever portion 76 extends from the throughbore 74, and is sealed therewith by the seal 78. The ratchet gear 24 is inserted into the drive cavity 26. The pawls 20, 22 and the spring 107 therebetween are positioned within the cavity 16 between the reversing lever post 144 and the ratchet gear 24, and above the reversing disc portion 90, one of the pawl selector posts 100 being received by one of the hooks 106. The spacer 140 is inserted with the spacer depending portion 123 between the reversing lever stop surfaces 120, the ears 170 being received in the ear recesses 172. If included, the leaf spring 202 is inserted between the pawls 20, 22 and the spacer 140.

The retaining ring 220, 520 is compressed, such as using a tool to engage the lug holes 224 to compress the arms 226, 526. The retaining ring 220, 520 is positioned in the cavity 16, while compressed, to abut the circumferential surface 32 of the ratchet gear 24. The axis of rotation 18 of the gear 24 passes through an inner opening of the retaining ring. The compression is releases to radially lock the retaining ring 220, 520 into the groove 230 in the sidewall of the ratchet body 14 within the cavity 16. Once locked, the retaining ring 220, 520 holds the ratchet gear 24 in place within the ratchet body 10.

The ball 112 is inserted into the throughbore 150, and then the spring 156 associated with the ball 112 is inserted into the through bore 150. The cover plate 50 is then installed such as with the two screws 54. The spacer 150 is restricted from shifting upward by the retaining ring 220 in a first embodiment, and by the cover plate 50 in a second embodiment (having the retaining ring 520). The spacer 150 is restricted from shifting downward by its cooperation with the reversing lever post 144. Generally, the design of the ratchet head 10 serves to retain the position of the ratchet gear in position using the radially locking retaining ring 220, 520. The position of the other components within the ratchet body 14 are held in place by the retaining ring 220, 520, the cover plate 50, and/or through cooperation with other components, thus limiting the need and use of other securements.

Although dual pawl ratchet mechanism are illustrated in FIGS. 1 and 5, other types of ratcheting mechanisms may be used. While two screws are used to secure the cover plate in FIGS. 1 and 5, one screw or three-or-more screws may instead be used.

As used in this disclosure, the term "a" or "one" may include one or more items unless specifically stated otherwise. Further, the phrase "based on" is intended to mean "based at least in part on" unless specifically stated otherwise.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A ratchet device comprising:

a body having first and second sides with a cavity disposed in the first side, wherein the cavity includes a drive cavity portion and an actuator cavity portion, and a first groove disposed in a sidewall of the drive cavity portion proximate to and substantially parallel with the first side;

a ratchet gear rotatably disposed in the drive cavity portion and having a drive post and circumferentially disposed ratchet teeth, wherein the drive post projects outwardly from the drive cavity portion;

a retaining ring engageable with the first groove to retain the ratchet gear in the drive cavity portion, wherein the retaining ring includes outwardly extending lug arms that extend toward and within the actuator cavity portion; and a cover plate disposed on the first side that encloses the cavity and includes an aperture, wherein the drive post projects outwardly from the ratchet body through the aperture, and wherein the retaining ring is disposed between the ratchet gear and a surface of the cover plate facing the ratchet gear.

2. The ratchet device of claim 1, wherein the ratchet gear further includes a circular body portion and a second groove circumferentially disposed between the drive post and the circular body portion, wherein the retaining ring is engageable with the second groove.

3. The ratchet device of claim 1, wherein the cavity further includes a pawl cavity portion disposed between the drive cavity portion and the actuator portion, and wherein the ratchet device further comprises a pawl disposed in the pawl cavity portion and that is selectively engageable with the ratchet teeth to select a drive direction in which the ratchet gear rotates relative to the body.

4. The ratchet device of claim 3, wherein the lug arms retain the pawl in the pawl cavity portion.

5. The ratchet device of claim 4, wherein each of the lug arms includes a lug hole adapted to allow engaging and disengaging the retaining ring from the first groove during assembly or disassembly of the ratchet device.

6. The ratchet device of claim 3, further comprising a reversing lever operably coupled with the pawl and adapted to rotate to select the drive direction of the ratchet gear.

7. The ratchet device of claim 6, further comprising a spacer disposed in the actuator cavity portion between the reversing lever and the cover plate, wherein the reversing lever is operably coupled with the pawl via the spacer to select the drive direction.

8. The ratchet device of claim 7, wherein the lug arms respectively retain the pawl and the spacer in the pawl cavity portion and the actuator portion.

9. The ratchet device of claim 7, further comprising:

a bore formed in the spacer;

a bias member disposed in the bore; and a ball disposed in the bore and biased by the bias member towards the reversing lever, wherein the reversing lever is rotatable with respect to the bore and has an axis of rotation substantially parallel to the bore, the reversing lever has an axially-oriented surface with a first recess for receiving the ball in a first lever position corresponding to a first drive direction and a second recess for receiving the ball in a second lever position corresponding to a second drive direction.

10. The ratchet device of claim 9, wherein the reversing lever includes a raised portion between the first and second recesses, the raised portion includes a peak and first and second ramps leading from the peak to the first and second recesses respectively.

11. A method of assembling a ratchet device comprising:

inserting a ratchet gear having a drive post and ratchet teeth into a cavity of a ratchet body, wherein the cavity includes a drive cavity portion and an actuator cavity portion, and the ratchet gear is disposed in the drive cavity portion;

engaging a retaining ring into a first groove disposed in a sidewall of the drive cavity portion to retain the ratchet gear in the drive cavity portion, wherein the retaining ring includes arms that extend toward and within the actuator cavity portion; and covering the cavity with a cover plate, wherein the drive post projects outwardly from the ratchet body through an aperture disposed in the cover plate, and wherein the retaining ring is disposed between the ratchet gear and a surface of the cover plate facing the ratchet gear.

12. The method of claim 11, further comprising coupling the cover plate to the ratchet body with a screw.

13. The method of claim 11, wherein the step of engaging a retaining ring includes disposing an inner portion of the retaining ring in a second groove disposed between a circular body portion of the ratchet device and the drive post.

14. The method of claim 13, further comprising compressing the retaining ring into the second groove.

15. The method of claim 14, wherein the step of engaging a retaining ring into the first groove includes releasing the retaining ring to allow an outer portion of the retaining ring to engage the first groove.

16. The method of claim 11, wherein the cavity further includes a pawl cavity portion disposed between the drive cavity portion and the actuator portion, and wherein the method further comprises disposing a pawl in the pawl cavity portion adjacent to the lug arms of the retaining ring, wherein the lug arms of the retaining ring retain the pawl in the pawl cavity portion, and the pawl is adapted to be selectively engaged with the ratchet teeth to select a drive direction in which torque is transmitted to a work piece.

17. The method of claim 16, further comprising disposing a spacer in the actuator cavity portion adjacent to the lug arms of the retaining ring, wherein the lug arms of the retaining ring retain the spacer in the actuator cavity portion.

18. The method of claim 17, wherein the step of disposing a spacer in the actuator cavity portion includes disposing the spacer between a reversing lever of the ratchet device and the cover plate, and wherein the reversing lever is operably coupled with the pawl via the spacer to select the drive direction.

19. A ratchet device comprising:

a body having first and second sides with a cavity disposed in the first side, wherein the cavity includes a drive cavity portion and an actuator cavity portion, and a first groove disposed in a sidewall of the drive cavity portion proximate to and parallel with the first side;

a ratchet gear rotatably disposed in the drive cavity portion and having a drive post and circumferentially disposed ratchet teeth, wherein the drive post projects outwardly from the drive cavity portion;

a retaining ring engageable with the first groove to retain the ratchet gear in the drive cavity portion, wherein the retaining ring includes outwardly extending lug arms that extend toward and within the actuator cavity portion, wherein the ratchet gear further includes a circular body portion and a second groove circumferentially disposed between the driver post and the circular body portion, and wherein the retaining ring is adapted to be engaged with the second groove; and a cover plate disposed on the first side that encloses the cavity and includes an aperture, wherein the drive post projects outwardly from the ratchet body through the aperture.

20. The ratchet device of claim 19, wherein the cavity further includes a pawl cavity portion disposed between the drive cavity portion and the actuator portion, and wherein the ratchet device further comprises a pawl disposed in the pawl cavity portion and that is selectively engageable with the ratchet teeth to select a drive direction in which the ratchet gear rotates relative to the body.

21. The ratchet device of claim 20, wherein the lug arms retain the pawl in the pawl cavity portion.

22. The ratchet device of claim 21, wherein each of the lug arms includes a lug hole adapted to allow engaging and disengaging the retaining ring from the first groove during assembly or disassembly of the ratchet device.

23. The ratchet device of claim 21, further comprising a reversing lever operably coupled with the pawl and adapted to rotate to select the drive direction of the ratchet gear.

24. The ratchet device of claim 23, wherein the lug arms respectively retain the pawl and the spacer in the pawl cavity portion and the actuator portion.

25. The ratchet device of claim 23, further comprising:

a bore formed in the spacer;

a bias member disposed in the bore; and a ball disposed in the bore and biased by the bias member towards the reversing lever, wherein the reversing lever is rotatable with respect to the bore and has an axis of rotation substantially parallel to the bore, the reversing lever has an axially-oriented surface with a first recess for receiving the ball in a first lever position corresponding to a first drive direction and a second recess for receiving the ball in a second lever position corresponding to a second drive direction.

26. The ratchet device of claim 25, wherein the reversing lever includes a raised portion between the first and second recesses, the raised portion includes a peak and first and second ramps leading from the peak to the first and second recesses respectively.

27. A method of assembling a ratchet device comprising:

inserting a ratchet gear having a drive post and ratchet teeth into a cavity of a ratchet body, wherein the cavity includes a drive cavity portion and an actuator cavity portion, and the ratchet gear is disposed in the drive cavity portion;

engaging a retaining ring into a first groove disposed in a sidewall of the drive cavity portion to retain the ratchet gear in the drive cavity portion, wherein the retaining ring includes arms that extend toward and within the actuator cavity portion, and wherein the step of engaging a retaining ring further includes disposing an inner portion of the retaining ring in a second groove disposed between a circular body portion of the ratchet device and the drive post; and covering the cavity with a cover plate, wherein the drive post projects outwardly from the ratchet body through an aperture disposed in the cover plate.

28. The method of claim 27, further comprising compressing the retaining ring into the second groove.

29. The method of claim 28, wherein the step of engaging a retaining ring into the first groove includes releasing the retaining ring to allow an outer portion of the retaining ring to engage the first groove.

30. The method of claim 27, wherein the cavity further includes a pawl cavity portion disposed between the drive cavity portion and the actuator portion, and wherein the method further comprises disposing a pawl in the pawl cavity portion adjacent to the lug arms of the retaining ring, wherein the lug arms of the retaining ring retain the pawl in the pawl cavity portion, and the pawl is adapted to be selectively engaged with the ratchet teeth to select a drive direction in which torque is transmitted to a work piece.

31. The method of claim 30, further comprising disposing a spacer in the actuator cavity portion adjacent to the lug arms of the retaining ring, wherein the lug arms of the retaining ring retain the spacer in the actuator cavity portion.

* * * * *